US007690236B2

(12) United States Patent
Otaki

(10) Patent No.: US 7,690,236 B2
(45) Date of Patent: Apr. 6, 2010

(54) METHOD AND APPARATUS FOR HOLE PUNCHING

(75) Inventor: Atsushi Otaki, Oyama (JP)

(73) Assignee: Showa Denko K.K., Tokyo (JP)

( * ) Notice: Subject to any disclaimer, the term of this patent is extended or adjusted under 35 U.S.C. 154(b) by 466 days.

(21) Appl. No.: 11/440,050

(22) Filed: May 25, 2006

(65) Prior Publication Data

US 2006/0288754 A1 Dec. 28, 2006

Related U.S. Application Data

(60) Provisional application No. 60/685,870, filed on Jun. 1, 2005.

(30) Foreign Application Priority Data

May 26, 2005 (JP) ..... 2005-153770

(51) Int. Cl.
*B21J 13/00* (2006.01)
*B21D 22/06* (2006.01)

(52) U.S. Cl. ..... 72/355.6; 72/355.4; 72/353.2; 72/360

(58) Field of Classification Search ..... 72/355.4, 72/355.6, 354.2, 356.6, 357, 360, 359, 325, 72/327–329, 353.2, 399, 403, 355.2; 470/25, 470/26, 91

See application file for complete search history.

(56) References Cited

U.S. PATENT DOCUMENTS 1,007,944 A * 11/1911 Hansen ..... 72/355.4
1,287,644 A * 12/1918 Colstello ..... 470/26
1,365,092 A * 1/1921 Costello ..... 470/26
1,812,023 A * 6/1931 Seavey ..... 72/328
4,382,324 A * 5/1983 Halene ..... 29/894.011
4,477,537 A * 10/1984 Blase et al. ..... 428/577
4,882,925 A * 11/1989 Ichie et al. ..... 72/356

(Continued)

FOREIGN PATENT DOCUMENTS

JP 56134036 A * 10/1981

(Continued)

*Primary Examiner*—Dana Ross
*Assistant Examiner*—Debra M Sullivan
(74) *Attorney, Agent, or Firm*—Oblon, Spivak, McClelland, Maier & Neustadt, L.L.P.

(57) ABSTRACT

A hole punching method capable of executing hole punching with high material yield at a low load and preventing occurrence of underfill is provided. The hole punching method includes a step of expanding a hole punching scheduled portion 2 of a raw material 1 disposed in a cavity 12 of a closed die 11 by pressing the hole punching scheduled portion 2 from opposite sides thereof across the hole punching scheduled portion 2 with a pair of large diameter punch and small diameter punch 13 and 15 different in diameter and arranged to as to face each other so that unfilled portions remain in the cavity, a step of penetrating the small diameter punch 13 into the hole punching scheduled portion 2 of the raw material 1 while releasing or after releasing pressurization by the large diameter punch 15 to the hole opening scheduled portion 2, and a step of penetrating the large diameter punch 15 into the hole punching scheduled portion 2 of the raw material 1 while pulling out or after pulling out the small diameter punch 13 penetrated in the hole punching scheduled portion 2 of the raw material 1 from the hole punching scheduled portion 2 of the raw material 1.

13 Claims, 11 Drawing Sheets

U.S. PATENT DOCUMENTS

| | | | | |
|---|---|---|---|---|
| 5,218,853 | A * | 6/1993 | Mueller et al. | 72/325 |
| 6,427,326 | B1 | 8/2002 | Soga et al. | |
| 7,107,808 | B2 * | 9/2006 | Miyahara | 72/329 |

FOREIGN PATENT DOCUMENTS

| | | |
|---|---|---|
| JP | 11-147157 | 6/1999 |
| JP | 2001-47172 | 2/2001 |
| JP | 2005-59097 | 3/2005 |
| WO | WO 2005/011893 A1 | 2/2005 |

* cited by examiner

METHOD AND APPARATUS FOR HOLE PUNCHING

This application claims priority to Japanese Patent Application No. 2005-153770 filed on May 26, 2005, and U.S. Provisional Application No. 60/685,870 filed on Jun. 1, 2005, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application No. 60/685,870 filed on Jun. 1, 2005, pursuant to 35 U.S.C. §111(b).

FIELD OF THE INVENTION

The present invention relates to a method and an apparatus for hole punching for use in manufacturing hole punched products, such as, e.g., arms or connecting rods for vehicles (e.g., automobiles, or railroad vehicles).

DESCRIPTION OF THE RELATED ART

Conventionally, in manufacturing hole punched products by forging, from the viewpoint of die life and safety, in place of directly executing hole punching of a hole punching scheduled portion of a raw material, it is common to initially form and shape the hole punching scheduled portion of the raw material so that a thin wall remains and then to remove the thin wall by, e.g., trimming.

On the other hand, Japanese Unexamined Laid-open Patent Publication No. H11-147157 discloses a method in which a preform is roughly molded in a cavity (molding space) of a closed die in one press cycle, then a hole punching scheduled portion is forged with a punch inserted in the closed die so that a thin material remains, and lastly the remained material is removed by punching processing with a punch (see Patent Document 1).

Patent Document 1: Japanese Unexamined Laid-open Patent Publication No. H11-147157

DISCLOSURE OF THE INVENTION

In the aforementioned conventional hole punching method, the remained material is required to be removed by punching after the full enclosed die forging, which requires a high forming load to prevent occurrence of underfill at the time of forging and results in low yield of materials.

The present invention was made in view of the aforementioned technical background, and aims to provide a hole punching method capable of executing hole punching at a low load with high yield of materials and further preventing occurrence of underfill, a hole punched product obtained by the method, and a hole punching apparatus for use in the aforementioned hole punching method.

The present invention has the following means.

[1] A hole punching method, comprising:

a step of expanding a hole punching scheduled portion of a raw material disposed in a cavity of a closed die by pressing the hole punching scheduled portion from opposite sides thereof across the hole punching scheduled portion with a pair of large diameter punch and small diameter punch different in diameter and arranged so as to face each other so that unfilled portions remain in the cavity;

a step of penetrating the small diameter punch into the hole punching scheduled portion of the raw material while releasing or after releasing pressurization by the large diameter punch to the hole punching scheduled portion; and a step of penetrating the large diameter punch into the hole punching scheduled portion of the raw material while pulling out or after pulling out the small diameter punch penetrated in the hole punching scheduled portion of the raw material from the hole punching scheduled portion of the raw material.

[2] The hole punching method as recited in the aforementioned Item 1, wherein a tip end portion of the small diameter punch is formed into a tapered shape, and wherein a peripheral surface of the tip end portion of the small diameter punch is formed by plural stepped taper surfaces arranged so as to decrease in taper angle gradually stepwise toward the tip end portion of the small diameter punch.

[3] The hole punching method as recited in the aforementioned Item 2, wherein, when the number of steps of the taper surfaces forming the peripheral surface of the tip end portion of the small diameter punch is N ($N \geqq 2$), a tip end portion of the large diameter punch is formed into a tapered shape, and a peripheral surface of the tip end portion of the large diameter punch is formed by stepped taper surfaces whose step number is smaller than N and arranged so as to decrease a taper angle gradually stepwise toward the tip end portion of the large diameter punch, or formed by a single step taper surface.

[4] The hole punching method as recited in any one of the aforementioned Items 1 to 3, wherein the closed die is provided with punch insertion holes each for inserting each punch, each punch insertion hole being communicated with the cavity, and wherein, in a state in which each punch is inserted in the corresponding punch insertion hole, gaps for receiving excessive material of the hole punching scheduled portion of the raw material from the cavity are formed between peripheral surfaces of the punches and peripheral surfaces of the punch insertion holes.

[5] The hole punching method as recited in the afore mentioned Item 4, wherein a dam portion for preventing the excessive material flowed into the gaps from discharging to an outside is formed at the peripheral surface of the punch so as to expand toward a radially outward of the punch.

[6] The hole punching method as recited in any one of the aforementioned Items 1 to 5, wherein, at the step of expanding, the hole punching scheduled portion is pressed from opposite sides thereof across the hole punching scheduled portion with both the punches so that the tip ends of both the punches do not come into contact with each other.

[7] The hole punching method as recited in any one of the aforementioned Items 1 to 6, wherein the raw material is a bar shaped material in which an axial prescribed portion of the raw material is defined as the hole punching scheduled portion, wherein the method further includes a diameter expanding step of expanding the hole punching scheduled portion of the raw material with an upsetting apparatus in advance to the expanding step, the upsetting apparatus being provided with a fixing die for securing the raw material, the fixing die being connected to the closed die, a guide having an insertion hole for inserting and holding the hole punching scheduled portion of the raw material in a buckling preventing state, and a pressure punch, and the guide having a pair of diameter expansion preventing protruded portions each protruded in an axial direction of the guide and integrally formed at opposed portions of the tip end portion of the guide across the insertion hole, wherein, at the diameter expansion step, the hole punching scheduled portion of the raw material secured to the fixing die is disposed in the cavity and the hole punching scheduled portion of the raw material is inserted and held in the insertion hole of the guide, and then, the guide is moved in a direction opposite to a moving direction of the pressure punch while axially pressing the hole punching scheduled portion of the raw material with the pressure punch by moving the pressure punch, to thereby expand the hole punching scheduled portion of the raw material exposed between the tip end portion of the guide and the fixing die in the cavity in a state in which contacting portions of the hole punching scheduled portion in contact with the guide protruded portions are prevented from being expanded in diameter, and wherein, at the expanding step, the expanded hole punching scheduled portion of the raw material is pressed with both the punches from both sides of the hole punching scheduled portion prevented in diameter expansion by the guide protruded portions in a state in which the hole punching scheduled portion expanded in diameter is disposed in the cavity.

[8] A hole punched product obtained by the hole punching method as recited in any one of the aforementioned Items 1 to 7.

[9] A hole punching apparatus, comprising:

a closed die having a cavity; and a pair of large diameter punch and small diameter punch different in diameter and disposed at opposite sides across a hole punching scheduled portion of a raw material disposed in the cavity of the closed die, wherein the hole punching scheduled portion of the raw material disposed in the cavity of the closed die is expanded with both the punches by pressing the hole punching scheduled portion from opposite sides across the hole punching scheduled portion, then, while releasing or after releasing pressurization by the large diameter portion to the hole punching scheduled portion, the small diameter punch is penetrated into the hole punching scheduled portion of the raw material, thereafter, while pulling out or after pulling out the small diameter punch penetrated in the hole punching scheduled portion of the raw material from the hole punching scheduled portion, the hole punching scheduled portion of the raw material is penetrated by the large diameter punch.

[10] The hole punching apparatus as recited in the aforementioned Item 9, wherein a tip end portion of the small diameter punch is formed into a tapered shape, and wherein a peripheral surface of the tip end portion of the small diameter punch is formed by plural stepped taper surfaces arranged so as to decrease in taper angle gradually stepwise toward the tip end portion of the small diameter punch.

[11] The hole punching apparatus as recited in the aforementioned Item 10, wherein, when the number of steps of the taper surfaces forming the peripheral surface of the tip end portion of the small diameter punch is N ($N \geqq 2$), a tip end portion of the large diameter punch is formed into a tapered shape, and a peripheral surface of the tip end portion of the large diameter punch is formed by stepped taper surfaces whose step number is smaller than N and arranged so as to decrease a taper angle gradually stepwise toward the tip end portion of the large diameter punch, or formed by a single step taper surface.

[12] The hole punching apparatus as recited in any one of the aforementioned Items 9 to 11, wherein the closed die is provided with punch insertion holes each for inserting each punch, each punch insertion hole being communicated with the cavity, and wherein, in a state in which each punch is inserted in the corresponding punch insertion hole, gaps for receiving excessive material of the hole punching scheduled portion of the raw material from the cavity are formed between peripheral surfaces of the punches and peripheral surfaces of the punch insertion holes.

[13] The hole punching apparatus as recited in the aforementioned Item 12, wherein a dam portion for preventing the excessive material flowed into the gaps from discharging to an outside is formed at the peripheral surface of the punch so as to expand toward a radially outward of the punch.

[14] The hole punching apparatus as recited in any one of the aforementioned Items 9 to 13, wherein the raw material is a bar shaped material in which an axial prescribed portion of the raw material is defined as the hole punching scheduled portion, wherein the apparatus further includes an upsetting apparatus for expanding the hole punching scheduled portion of the raw material before expanding the hole punching scheduled portion of the raw material, wherein the upsetting apparatus is provided with a fixing die for securing the raw material, the fixing die being connected to the closed die, a guide having an insertion hole for inserting and holding the hole punching scheduled portion of the raw material in a buckling preventing state, and a pressure punch for axially pressing the hole punching scheduled portion of the raw material inserted in the insertion hole of the guide, and a punch driving apparatus for moving the guide in a direction opposite to a moving direction of the pressure punch, the guide having a pair of diameter expansion preventing protruded portions each protruded in an axial direction of the guide and integrally formed at opposed portions of the tip end portion of the guide across the insertion hole, and wherein a part of a peripheral surface of the hold punching scheduled portion is brought into contact with side surfaces of the protruded portions of the guide at the time of expanding the hole punching scheduled portion of the raw material to thereby prevent a contacting portion of the hole punching scheduled portion in contact with the protruded portions from being expanded.

The present invention has the following effects.

According to the invention as recited in the aforementioned Item [1], the hold punching scheduled portion of the raw material disposed within the cavity of the closed die is pressed from the opposite sides thereof across the hold punching scheduled portion with the pair of large and small diameter punches to expand the hole punching scheduled portion so that unfilled portions remain in the cavity. Therefore, the hole punching scheduled portion can be expanded within the cavity at a low load.

Furthermore, a hole can be formed by a relatively small load since a small diameter hole is opened in the hole punching scheduled portion by penetrating the small diameter punch into the hole punching scheduled portion of the raw material. Furthermore, the penetration operation of the small diameter punch causes the material of the hole punching scheduled portion of the raw material to be filled in the unfilled portions located at the penetration front side of the small diameter punch among the unfilled portions in the cavity.

Furthermore, since the small diameter hole can be expanded by penetrating the large diameter punch into the small diameter hole formed in the hole punching scheduled portion of the raw material to thereby form a large diameter hole in the hole punching scheduled portion, the hole can be opened at a relatively low load. Furthermore, the penetration operation of the large diameter punch causes the material of the hole punching scheduled portion of the raw material to be filed in the unfilled portions located at the penetration front side of the large diameter punch among the unfilled portions in the cavity. Consequently, almost all of the unfilled portions in the cavity disappear and the entire cavity is filled with the material, which in turn prevents occurrence of underfill.

The hole punching method of this invention is not a method in which a hole is formed by punching and removing the material of the hole punching scheduled portion of the raw material, and therefore the yield of material is high.

According to the invention as recited in the aforementioned Item [2], the tapered tip end portion of the small diameter punch enables penetration of the hole punching scheduled portion of the raw material at a low load. Furthermore, since the peripheral surface of the tip end portion of the small diameter punch is formed by plural stepped taper surfaces arranged so as to decrease in taper angle gradually stepwise toward the tip of the small diameter punch, the forming load can be adjusted to a prescribed value by setting the plural stepped taper angles of the small diameter punch. Furthermore, the penetration operation of the small diameter punch enables an effective radially outward expansion of the hole punching scheduled portion of the raw material, which enables assured filling of the material of the hole punching scheduled portion of the raw material in the unfilled portions located at the penetration front side of the small diameter punch among the unfilled portions in the cavity.

According to the invention as recited in the aforementioned Item [3], the tapered tip end portion of the large diameter punch enables penetration of the large diameter punch into the hole punching scheduled portion of the raw material at a low load. Furthermore, since the peripheral surface of the tip end portion of the large diameter punch is formed by tapered surfaces with the number of steps fewer than N, the tapered surfaces being arranged so as to decrease the taper angle gradually stepwise toward the tip end of the large diameter portion, or formed by a single step of a taper surface, the forming load can be adjusted to a prescribed value. And, the penetration operation of the large diameter punch enables effective radially outward expansion of the hole punching scheduled portion of the raw material, thereby enabling assured filling of the material of the hole punching scheduled portion of the material in the unfilled portions located at the penetration front side of the large diameter punch among the unfilled portions in the cavity.

According to the invention as recited in the aforementioned Item [4], in the state where each punch is inserted in the corresponding punch insertion hole, a gap for receiving excessive material of the hole punching scheduled portion of the raw material from the cavity is formed between the peripheral surface of the punch and the peripheral surface of the punch insertion hole. Therefore, the material of the hole punching scheduled portion of the raw material can be filled in the unfilled portion in the cavity at a relatively low load.

According to the invention as recited in the aforementioned Item [5], the excessive material can be prevented from flowing out of the closed die.

According to the invention as recited in the aforementioned Item [6], occurrence of breakages and/or damages of the punch tip end portions, which may occur due to the contact of the tips of the punches, can be prevented.

According to the invention as recited in the aforementioned Item [7], in the case where the hole punching scheduled portion of the raw material is expanded in diameter beforehand and then hole punching is executed to the hole punching scheduled portion, these processing can be performed effectively.

According to the invention as recited in the aforementioned Item [8], a hole punched product with no or almost no underfill can be obtained.

According to the invention as recited in the aforementioned Item [9] to [14], a hole punching apparatus which can be preferably used for the hole punching method of the present invention can be provided.

DETAILED DESCRIPTION OF THE PREFERRED EMBODIMENTS

Next, an embodiment of the present invention will be explained below with reference to the attached drawings.

Figure 1:
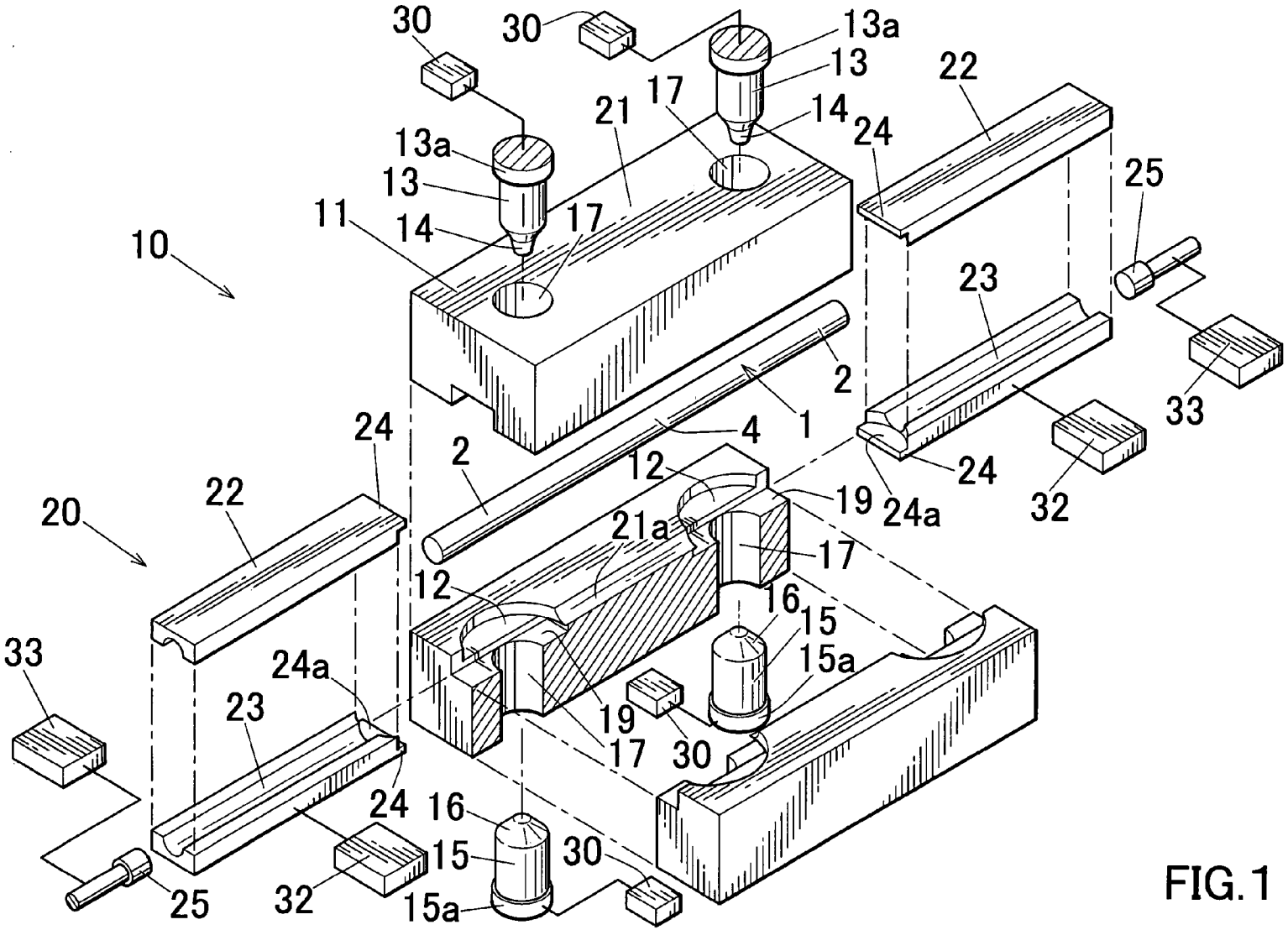
FIG. 1 is an exploded perspective view of a hole punching apparatus according to an embodiment of the present invention.

In FIG. 1, "10" denotes a hole punching apparatus according to this embodiment, and "1" denotes a raw material. Furthermore, in FIG. 13, "6" denotes a hole punched product (hole punched article) manufactured with the hole punching apparatus 1. This hole punched product 6 is used as a preform for manufacturing arms for vehicles, such as, e.g., automobiles or railroad vehicles.

As shown in FIG. 1, the raw material 1 is a straight bar-shaped member made of, e.g., aluminum (including its alloy). The raw material 1 is circular in cross-section and constant in cross-sectional area along the axial direction.

In the present invention, the quality of material of the raw material 1 is not limited to aluminum, and can be metal, such as, e.g., brass, copper, or stainless steel, or plastic. Moreover, the cross-sectional configuration of the raw material 1 is not limited to a circle configuration, and can be a polygonal configuration, such as, e.g., a square configuration or a hexagonal configuration.

Figure 13:
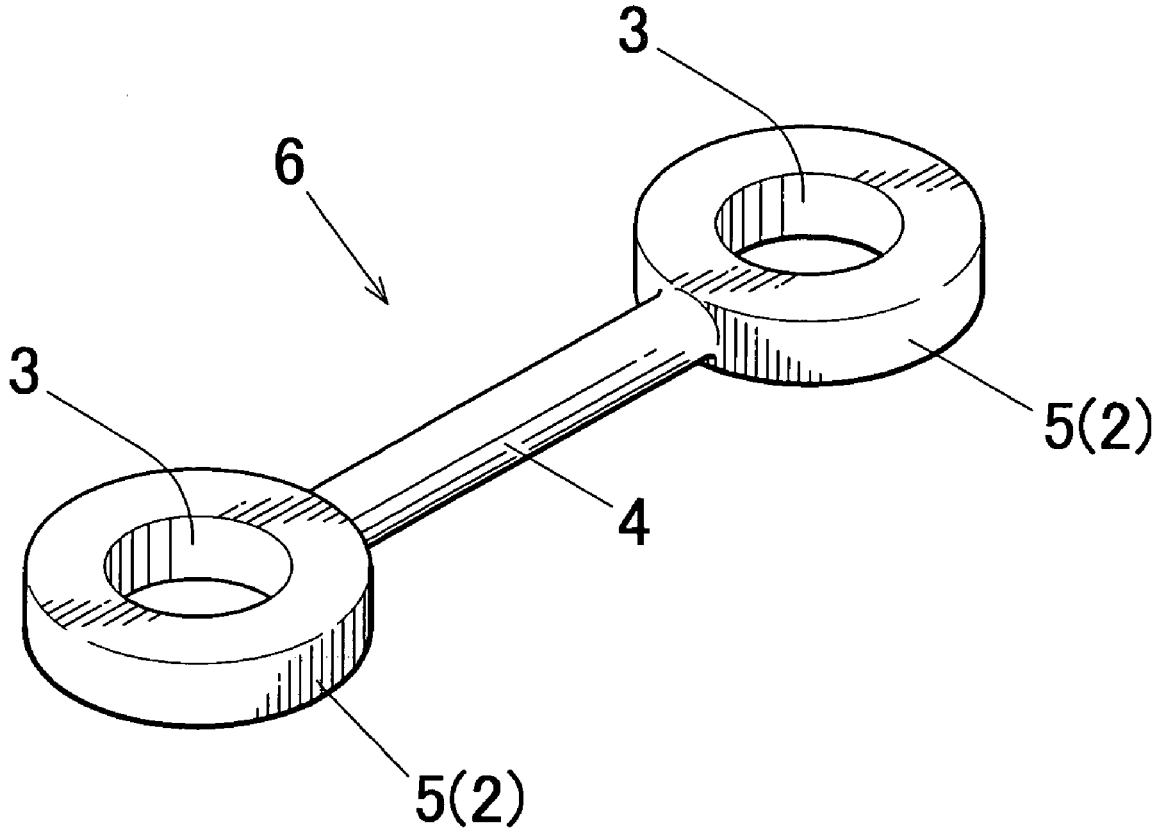
FIG. 13 is a perspective view of the punched member obtained by the hole punching apparatus.

The hole punching scheduled portion 2 of this raw material 1 is located at each of the axial end portions of the raw material 1. More specifically, it is located at both end portions of the raw material 1. In other words, both the end portions of the raw material 1 are defined as hole punching scheduled portions 2. Each of the hole punching scheduled portions 2 of the raw material 1 is expanded into an approximate circular plate shape, and thereafter the expanded hole punching scheduled portion is punched to thereby obtain a hole punched product 6 as shown in FIG. 13.

In this hole punched product 6, the portion to which hole punching was executed, i.e., a hole punched portion 5, corresponds to a connecting portion to be connected with other component of an arm for vehicles. The hole 3 formed in this hole punched portion 5 corresponds to, e.g., a bush mounting hole. This hole 3 is penetrated in the thickness direction of the hole punching scheduled portion 2 expanded into a circular plate shape, and is circular in cross-sectional configuration.

In this hole punched product 6, for example, each hole punched portion 5 is 70 mm in diameter, 24 mm in thickness, the hole 3 is 30 mm in diameter, and the length between the hole punched portions 5 and 5 is 300 mm. The raw material 1 is 18 mm in diameter. In the present invention, however, the dimension of each portion of the punched product 6 and the diameter of the raw material 1 are not limited to the above-mentioned dimension. For example, the dimension of each portion and the diameter of the raw material 1 can be set so that the purpose of the present invention can be attained in accordance with the manufacture of the punched product 6, such as, e.g., an arm for vehicles (e.g., cars, or railroad vehicles), or a connecting rod.

The hole punching apparatus 10 of this embodiment is for forming a hole 3 in the hole punching scheduled portion 2 of the raw material 1, and, as shown in FIG. 1, is equipped with a closed die 11 (closed die assembly), two pairs of punches 13 and 15 (i.e., hole punches), a punch driving apparatus 30 for moving each punch 13 and 15, and an upsetting apparatus 20.

The closed die 11 has two cavities 12 and 12 each for forming each hole punching scheduled portion 2 of the raw material 1 into a prescribed configuration (i.e., a circular plate). Both the cavities 12 and 12 are disposed apart from each other in the axial direction of the closed die 11. Furthermore, this closed die 11 is divided into two pieces, or upper and lower pieces, along the axial direction.

In the cavities 12 of the closed die 11, the hole punching scheduled portions 2 of the raw material 1 are to be placed.

The pair of punches 13 and 15 are formed into a circular configuration in cross-section, respectively. Each punch 13 and 15 is for forming a hole 3 in the corresponding hole punching scheduled portion 2 of the raw material 1. Both the punches 13 and 15 are different in diameter. Both the punches 13 and 15 are disposed so as to face each other across the hole punching scheduled portion 2 of the raw material 1 placed in the cavity 12. In other words, both the punches 13 and 15 are placed so as to face each other at opposite sides across the cavity 12. In this embodiment, the punches 13 and 15 are vertically faced each other.

In this specification, among both the punches 13 and 15, the punch having a larger diameter will be referred to as "large diameter punch 15," and the punch having a smaller diameter will be referred to as "small diameter punch 13."

The diameter of the large diameter punch 15 is set to the same diameter as the diameter of the prescribed hole 3. On the other hand, the diameter of the small diameter punch 13 is set to a diameter smaller than the diameter of the large diameter punch 15, and is decided by calculation depending on various conditions, such as, e.g., the ability of the punch driving apparatus 30 for driving the small diameter punch 13, the stroke of the small diameter punch 13 required for punching the hole punching scheduled portion 2, or the taper angle of the peripheral surface of the tip end portion of the small diameter punch 13. For example, the diameter of the small diameter punch 13 is set so as to fall within the range of 0.4 times or more of the diameter of the large diameter punch 15 and less than 1 time of the diameter of the larger diameter punch 15 (preferably, from 0.66 to 0.95 times). In the present invention, however, the diameter of the small diameter punch 13 is not necessarily required to fall within the aforementioned range.

Figure 4:
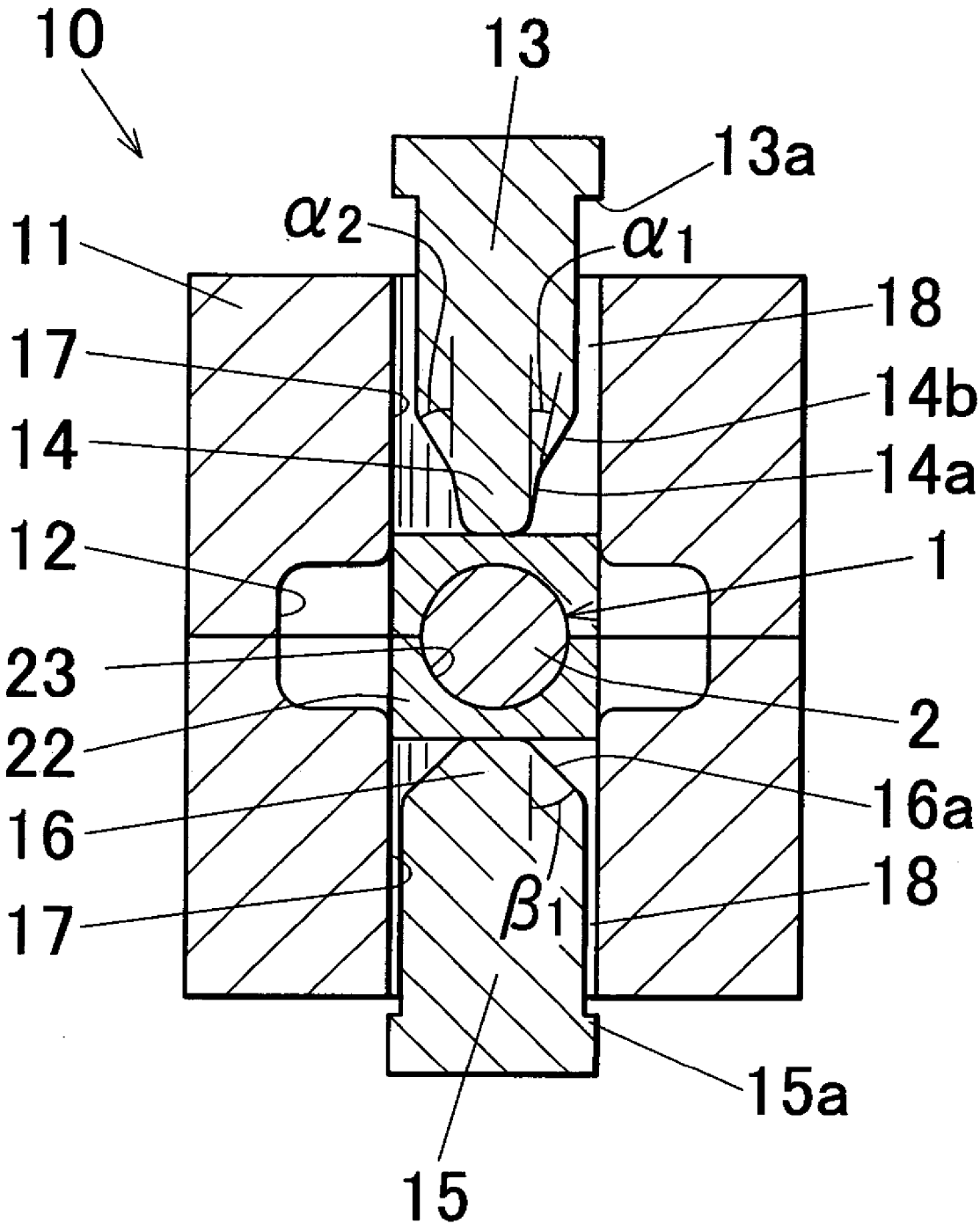
FIG. 4 is a cross-sectional view taken along the line A-A in FIG. 2.

The tip end portion 14 of the small diameter punch 13 is formed into a tapered shape as shown in FIG. 4. Furthermore, the peripheral surface of the tip end portion 14 of the small diameter punch 13 is formed by plural stepped taper surfaces 14*a* and 14*b* gradually decreasing stepwise in taper angle $\alpha 1$ and $\alpha 2$ toward the tip end of the small diameter punch 13. In this embodiment, the number of steps of the taper surfaces 14*a* and 14*b* is two. Therefore, among these taper angles $\alpha 1$ and $\alpha 2$ of these taper surfaces 14*a* and 14*b*, the taper angle $\alpha 1$ of the first step counted from the tip end of the small diameter punch 13 and the taper angle $\alpha 2$ of the second step counted therefrom are set to $\alpha 1 < \alpha 2$.

The tip end portion 16 of the large diameter punch 15 is formed into a tapered shape. For convenience of explanation, it is assumed that the number of steps of the taper surfaces 14*a* and 14*b* forming the peripheral surface of the tip end portion 14 of the small diameter punch 13 is N ($N \geqq 2$). In this case, the peripheral surface of the tip end portion 16 of the large diameter punch 15 is formed by taper surfaces having the number of steps smaller than N and arranged so that the taper angle decreases gradually stepwise toward the tip end of the large diameter punch 15. In this embodiment, since N=2, the peripheral surface of the tip end portion 16 of the large diameter punch 15 is formed by a single step taper surface 16*a*. "$\beta 1$" denotes a taper angle of this taper surface 16*a*.

In the present invention, "N" is not limited to 2 (N=2), and can be, for example, 3, 4 or 5, as long as $N \geqq 2$. Furthermore, the number of steps of the taper surface 16*a* forming the peripheral surface of the tip end portion 16 of the large diameter punch 15 is not limited to one, and can be, for example, 1 or 2 in the case of N=3, 1 to 3 in the case of N=4, or 1 to 4 in the case of N=5, as long as the number of steps is smaller than N.

In this specification, the taper angle $\alpha 1$, $\alpha 2$ or $\beta 1$ of the taper surface 14*a*, 14*b* or 16*a* denotes an angle of the taper surface 14*a*, 14*b* or 16*a* to the axis of the punch 13 or 15.

The tip end face of each punch 13 and 15 is formed into a flat configuration. In the present invention, however, it is not limited that the tip end face of each punch 13 and 15 is formed into a flat configuration, and can be formed into, for example, a convex configuration.

Both the punches 13 and 15 are connected to punch driving apparatuses 30, respectively. It is configured such that the operation of the punch driving apparatus 30 causes frontward and backward movements of the corresponding punch 13 and 15, or the punch 13 and 15 can be advanced into and retreated from the cavity 12.

The punch driving apparatus 30 is configured to give driving force to the punch 13 and 15 by, e.g., machine cams using a pressing machine, fluid pressure (e.g., oil pressure, or gas pressure), or an electric motor.

Punch insertion holes 17 and 17 each for fitting the corresponding punch 13 and 15 are formed in the opposite portions (upper and lower portions in this embodiment) of the closed die 11 facing across the cavity 12 so as to communicate with the cavity 12. Each punch 13 and 15 is inserted in the corresponding punch insertion hole 17 and 17 in a vertically movable manner. In this state, as shown in FIG. 4, a gap 18 and 18 is formed between the peripheral surface of each punch 13 and 15 and the peripheral surface of each punch insertion hole 17 and 17 (the so-called clearance between the punch 13 and 15 and the punch insertion hole 17 and 17) along the entire periphery of each punch 13 and 15 in the peripheral direction thereof. Excessive material (the so-called excess metal) 2*a* of the hole punching scheduled portion 2 of the raw material 1 flows into this gap 18 from the cavity 12 (see FIG. 11 and FIG. 12). The excessive material 2 flowed into this gap 18 will remain at the periphery of the hole 3 as burrs.

At the peripheral surface of each punch 13 and 15, a dam portion 13*a* and 15*b* for preventing the excessive material 2*a* flowed into the gap 18 from being flowed out of the closed die 11 is integrally formed radially outwardly along the entire periphery of the punch 13 and 15.

The upsetting apparatus 20 is for simultaneously expanding both the hole punching scheduled portions 2 and 2 of the raw material 1.

Figure 2:
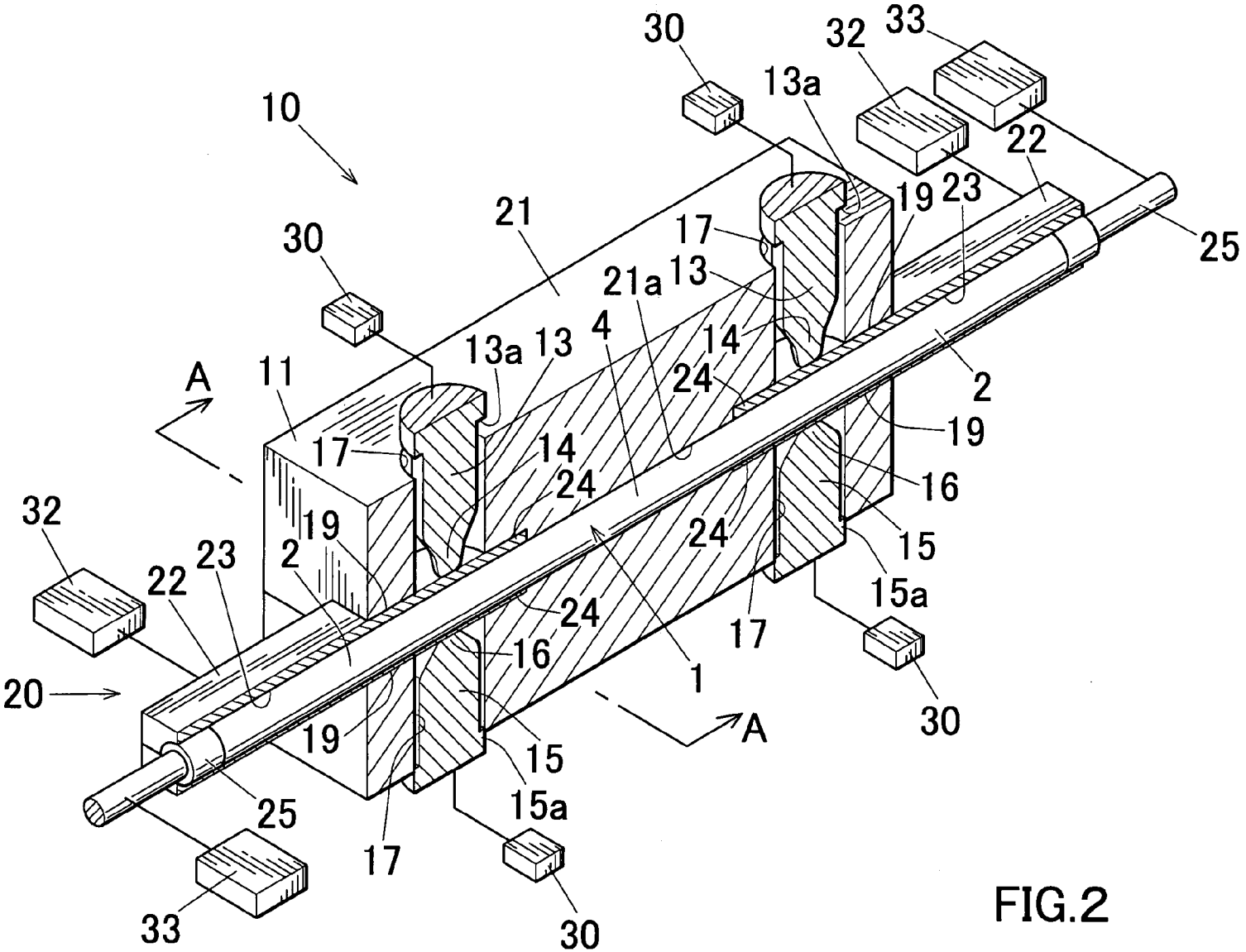
FIG. 2 is a cross-sectional perspective view of the hole punching apparatus in the state before expanding the hole punching scheduled portion of the raw material with the hole punching apparatus.
Figure 3:
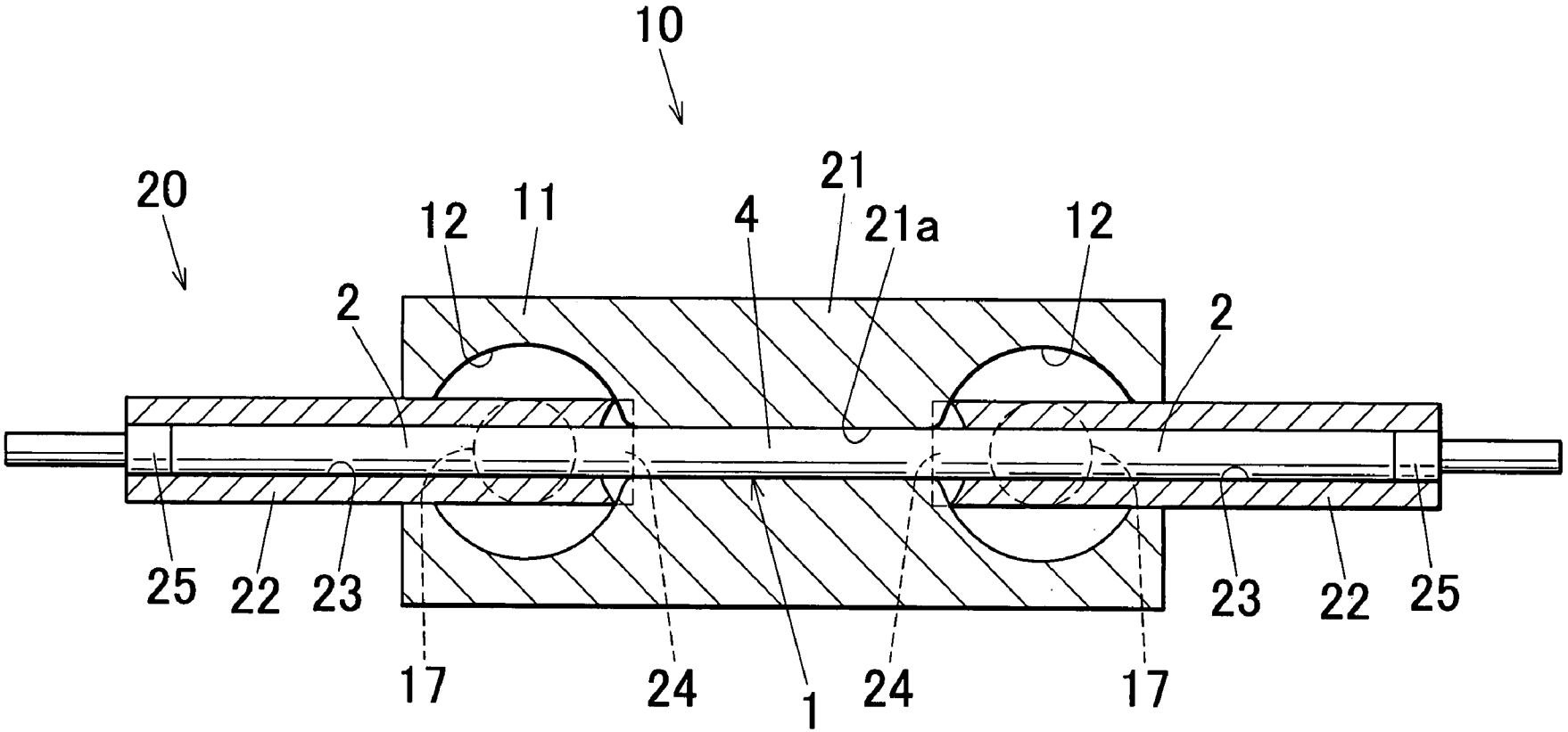
FIG. 3 is a horizontal cross-sectional view of the hole punching apparatus in the state shown in FIG. 2.

This upsetting apparatus 20 is equipped with, as shown in FIGS. 1 to 3, a fixing die 21 for fixing the raw material 1, the fixing die 21 being connected to the closed die 11, two guides 22 and 22, two pressure punches 25 and 25 (i.e., upsetting punches), two guide driving apparatuses 32 and 32, and two pressure punch driving apparatuses 33 and 33.

The fixing die 21 consists of a portion of the closed die 11 located between both the cavities 12 and 12, and is integrally formed with the closed die 11. The fixing die 21 is divided into upper and lower halves along the axial direction. The divided members of the closed die 11 and the fixing die 21 are held by a die holding member (not illustrated) in a mutually assembled manner, so that the closed die 11 and fixing die 21 cannot be disassembled unexpectedly. In the present invention, the closed die 11 and the fixing die 21 can be separated members.

The fixing die 21 is for securing the raw material 1 so as not to move in the axial direction unexpectedly at the time of the diameter expansion. The fixing die 21 is provided with a raw material fixing insertion hole 21*a* for securing an axial intermediate portion 4 of the raw material 1 as a non-hole punching scheduled portion in a fitted manner. The insertion hole 21*a* is extended in an axial direction of the fixing die 21 and communicated with both the cavities 12 and 12. When the axial intermediate portion 4 of the raw material 1 is fitted in the raw material fixing insertion hole 21*a*, the raw material 1 is immovably secured in the axial direction, and the diameter expansion and buckling of the axial intermediate portion 4 of the raw material 1 are prevented.

The two guides 22 and 22 are the same in structure. Each guide 22 has an insertion hole 23 for fitting and holding the corresponding hole punching scheduled portion 2 of the raw material 1 in a buckling preventing state. This insertion hole 23 is extended in the axial direction of the guide 20 and penetrated in the guide 20. The diameter of this insertion hole 23 is set to a size capable of closely fitting and axially slidably inserting the hole punching scheduled portion 2 of the raw material 1.

A pair of diameter expansion preventing protruded portions 24 are integrally protruded from the tip end portion of the guide 22 in the axial direction of the guide 22, so that the protruded portions 24 are moved together with the guide 22 in accordance with the movement of the guide 22. A part of the peripheral surface of the hole punching scheduled portion 2 of the raw material 1 inserted in the insertion hole 23 of the guide 22 comes into contact with the side surface 24*a* of each protruded portion 24 facing to the insertion hole 23 at the time of expanding the hole punching scheduled portion 2, whereby the expansion of the contacting portion of the hole punching scheduled portion 2 in contact with the protruded portion 24 is controlled.

On the other hand, on the upper and lower surfaces of the cavity 12 of the closed die 11, a slide groove portion 19 extended in the axial direction of the closed die 11 is formed, respectively, so that the protruded portion 24 of the guide 22 is slidably inserted in this slide groove portion 19 in the axial direction of the closed die 16.

Furthermore, the side surface 24*a* of the protruded portion 24 of the guide 22 with which a part of the peripheral surface of the hole punching scheduled portion 2 of the raw material 1 comes into contact is formed into a surface corresponding to the peripheral surface configuration of the hole punching scheduled portion 2 where the raw material is expanded in diameter. In the state in which the protruded portion 24 is inserted in the slide groove portion 19, the side surface 24*a* of the protruded portion 24 is flush with the upper or lower surface of the cavity 12. In this embodiment, the side surface 24*a* of this protruded portion 24 is formed into a flat configuration corresponding to the surface of the circle configuration of the thickness direction both sides of the hole punching scheduled portion 2 expanded into an approximately circular plate.

Furthermore, each guide 22 is divided into two pieces, i.e., upper and lower pieces, divided by a dividing plane longitudinally dividing the insertion hole 23. The divided members of each guide 22 are held by a guide holding member (not illustrated) in a mutually assembled manner, so that the guide 22 is not disassembled unexpectedly.

Each pressure punch 25 is for axially pressurizing a corresponding hole punching scheduled portion 2 of the raw material 1. Both the pressure punches 25 and 25 are disposed at the axial both end portions of the raw material 1 so as to face each other.

Each pressure punch driving apparatus 33 is for moving each pressure punch 25 in the axial direction of the raw material 1 to thereby give driving force for pressurizing the hole punching scheduled portion 2 of the raw material 1 to the pressure punch 25. Each pressure punch driving apparatus 33 is connected to the corresponding pressure punch 25. The pressure punch driving apparatus 33 is configured to give driving force to the pressure punch 25 with machine cams using, e.g., a pressing machine, fluid pressure (e.g., oil pressure, gas pressure), or electric motors.

Figure 6:
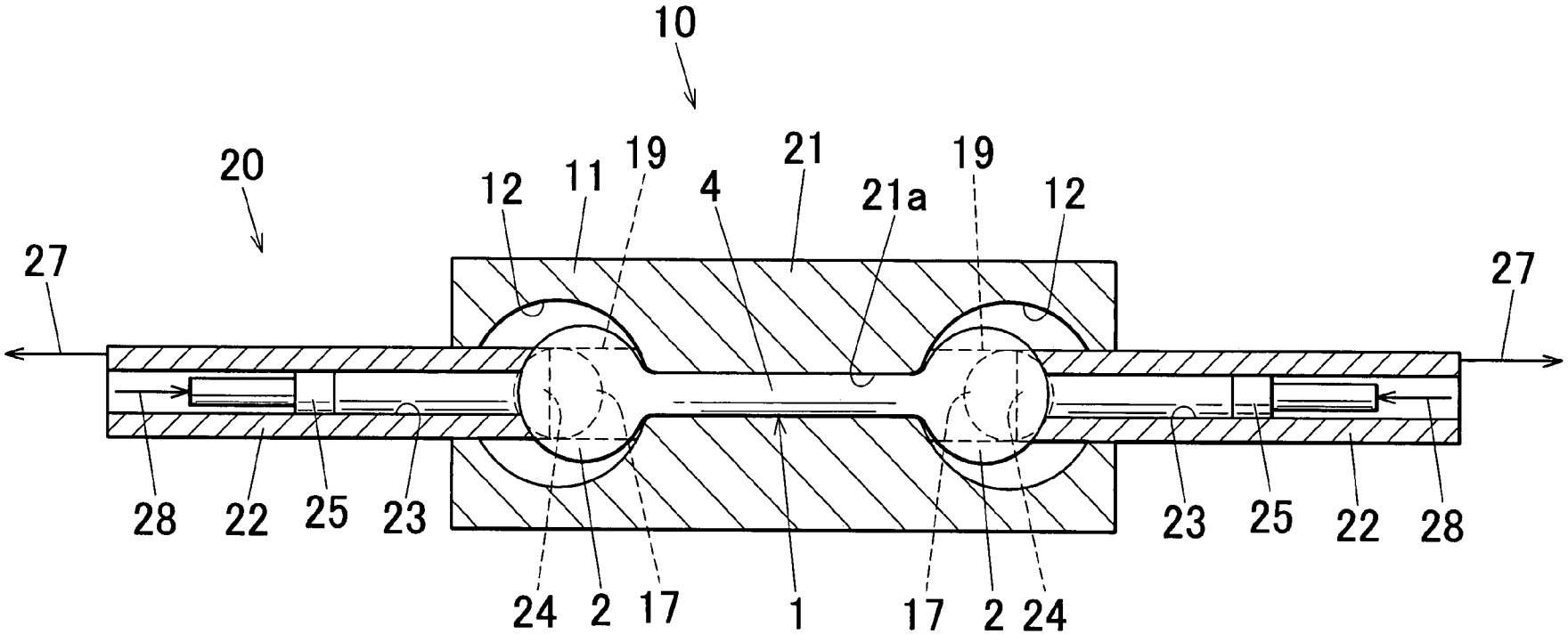
FIG. 6 is a horizontal cross-sectional view of the hole punching apparatus in the state shown in FIG. 5.

Each guide driving apparatus 32 is for moving each guide 22 in a direction 27 opposite to the moving direction 28 of the corresponding pressure punch 25 (i.e., in the pressurizing direction to the raw material hole punching scheduled portion 2 by the pressure punch 25) (see FIG. 6). Each guide driving apparatus 32 is connected to the corresponding guide 22. The guide driving apparatus 32 is configured to give driving force to the guide 22 with machine cams or fluid pressure using, e.g., pressing machines (e.g., oil pressure or gas pressure), electric motors, or springs.

Now, a hole punching method using the aforementioned hole punching apparatus 10 will be explained below.

Initially, as shown in FIGS. 2 to 7, each hole punching scheduled portion 2 of the raw material 1 is preliminarily expanded in diameter by the upsetting apparatus 20 of the hole punching apparatus 10 [DIAMETER EXPANSION STEP]. In this embodiment, both the hole punching scheduled portions 2 and 2 of the raw material 1 will be simultaneously expanded in diameter.

This diameter expansion method will be explained below.

As shown in FIGS. 2 to 4, by fitting the axial intermediate portion 4 which is a non-hole punching scheduled portion of the raw material 1 in the raw material fixing insertion hole 21*a* of the fixing die 21, the raw material 1 is secured to the fixing die 21 so that the raw material 1 cannot be unexpectedly moved in the axial direction while disposing each hole punching scheduled portion 2 of the raw material 1 in the corresponding cavity 12. In this embodiment, the hole punching scheduled portion 2 of the raw material 1 is placed in the cavity 12 in a penetrated manner. Therefore, only the portions of the hole punching scheduled portion 2 of the raw material 1 near the axial intermediate portion of the raw material 1 are placed in the cavities 12, and the end portions of the hole punching scheduled portions 2 are placed so as to protrude from the cavities 12.

Furthermore, each hole punching scheduled portion 2 of the raw material 1 is inserted in the corresponding insertion hole 23 of the guide 22 to thereby hold each hole punching scheduled portion 2 in a buckling preventing state. Furthermore, the corresponding protruded portion 24 of the guide 22 is inserted into each slide groove portion 19 of the closed die 11. In this state, the opposing portions of the peripheral surface of each hole punching scheduled portion 2 of the raw material 1 are in contact with the side surfaces 24*a* and 24*a* of both the protruded portions 24 and 24 of the guide 22.

Figure 5:
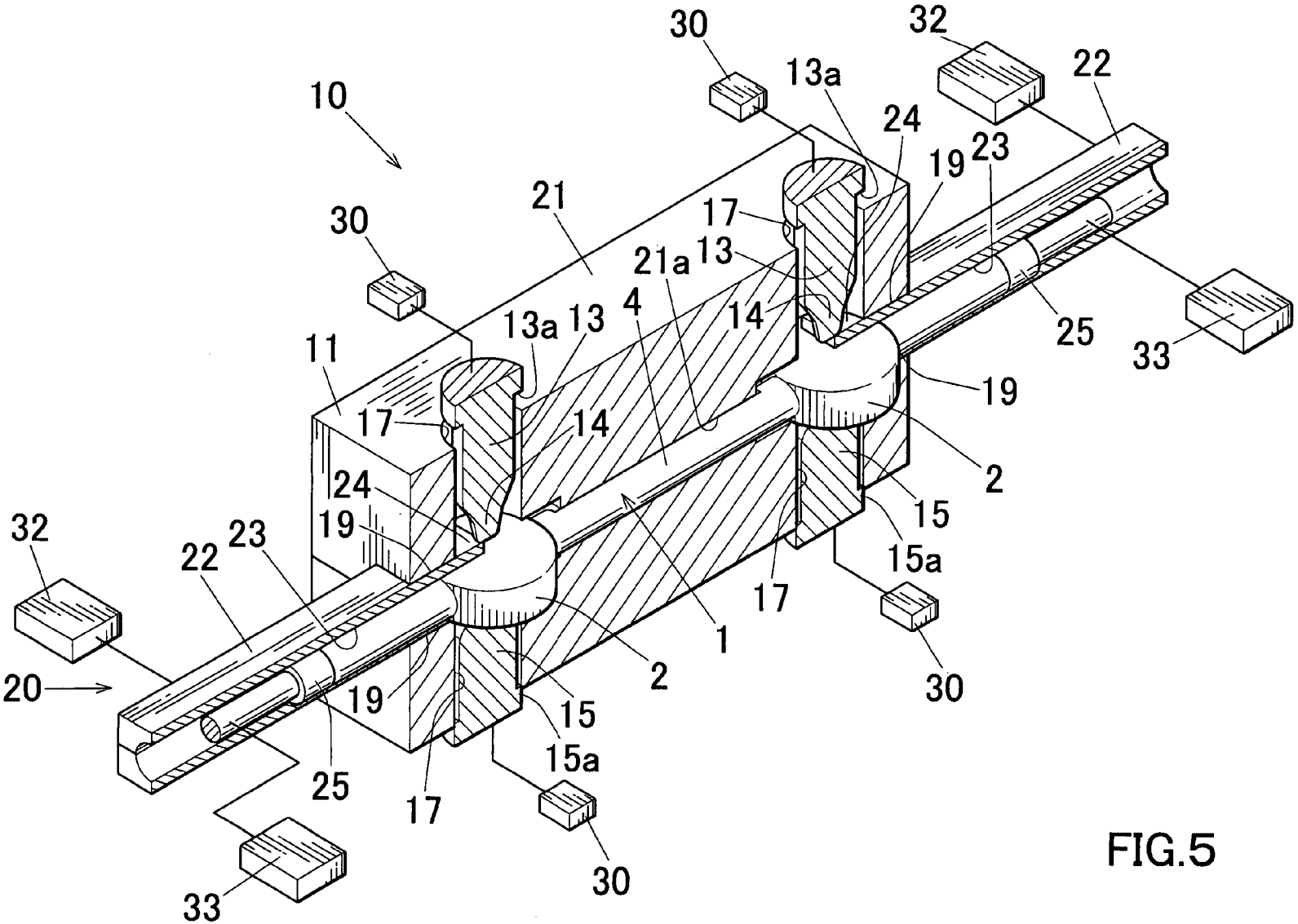
FIG. 5 is a cross-sectional perspective view of the hole punching apparatus in the middle of expanding the hole punching scheduled portion of the raw material with the hole punching apparatus.

Next, as shown in FIGS. 5 and 6, while simultaneously axially pressurizing the hole punching scheduled portions 2 and 2 of the raw material 1 with the corresponding pressure punches 25 and 25 by moving both the pressure punches 25 and 25 by simultaneously operating both the pressure punch driving apparatuses 33 and 33, both the guides 22 and 22 are simultaneously moved in a direction 27 opposite to the moving direction 28 of the corresponding pressure punch 25 by simultaneously operating both the guide driving apparatuses 32 and 32. With this, a part of the peripheral surface of the hole punching scheduled portion 2 of the raw material 1 exposed between the tip end portion of each guide 22 and the fixing die 21 is brought into contact with the side surfaces 24*a* and 24*a* of the protruded portions 24 of the guide 22 and therefore the contacting portion of the hole punching scheduled portion 2 in contact with the guide protruded portions 24*a* and 24*a* is prohibited from being expanded in diameter. In this diameter expansion restricted state, the hole punching scheduled portion 2 (in detail, the portion other than the contacting portion of the peripheral surface of the hole punching scheduled portion 2 in contact with the guide protruded portions 24) will be expanded in the cavity 12.

In the present invention, the traveling speed of the pressure punch 25 and the traveling speed of the guide 22 are set depending on the diameter expansion designed shape of the hole punching scheduled portion 2 of the raw material 1. Such traveling speed can be constant or variable.

In accordance with the movement of the pressure punch 25 and the guide 22, the hole punching scheduled portion 2 of the raw material 1 is gradually expanded in the cavity 12 and the material of the hole punching scheduled portion 2 is filed in the cavity 12 in a state in which the contacting portions of the hole punching scheduled portion 2 in contact with the guide protruded portions 24 and 24 are restricted from being expanded in diameter.

Figure 7:
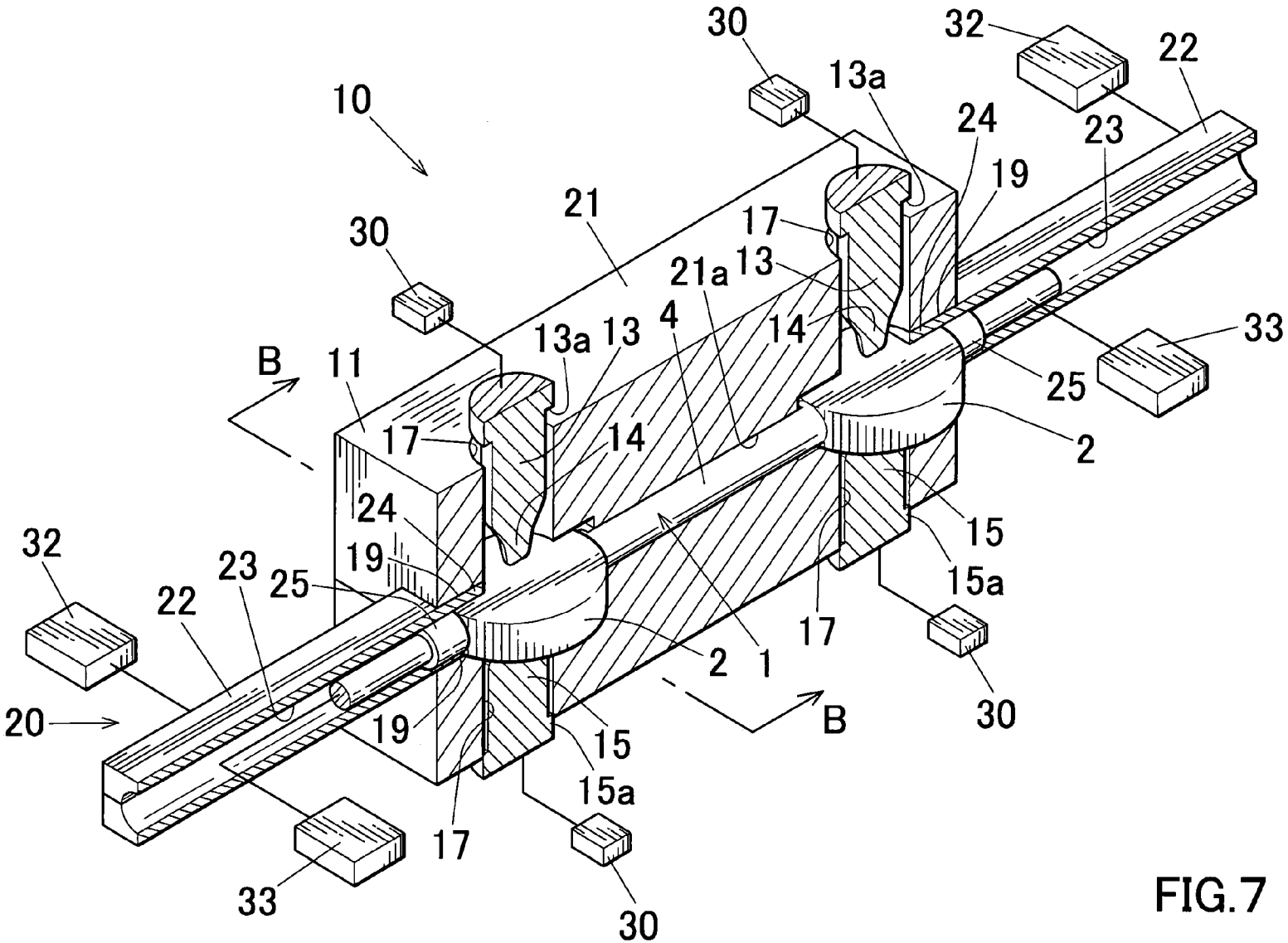
FIG. 7 is a cross-sectional perspective view of the hole punching apparatus in the state after expanding the hole punching scheduled portion of the raw material with the hole punching apparatus.
Figure 8:
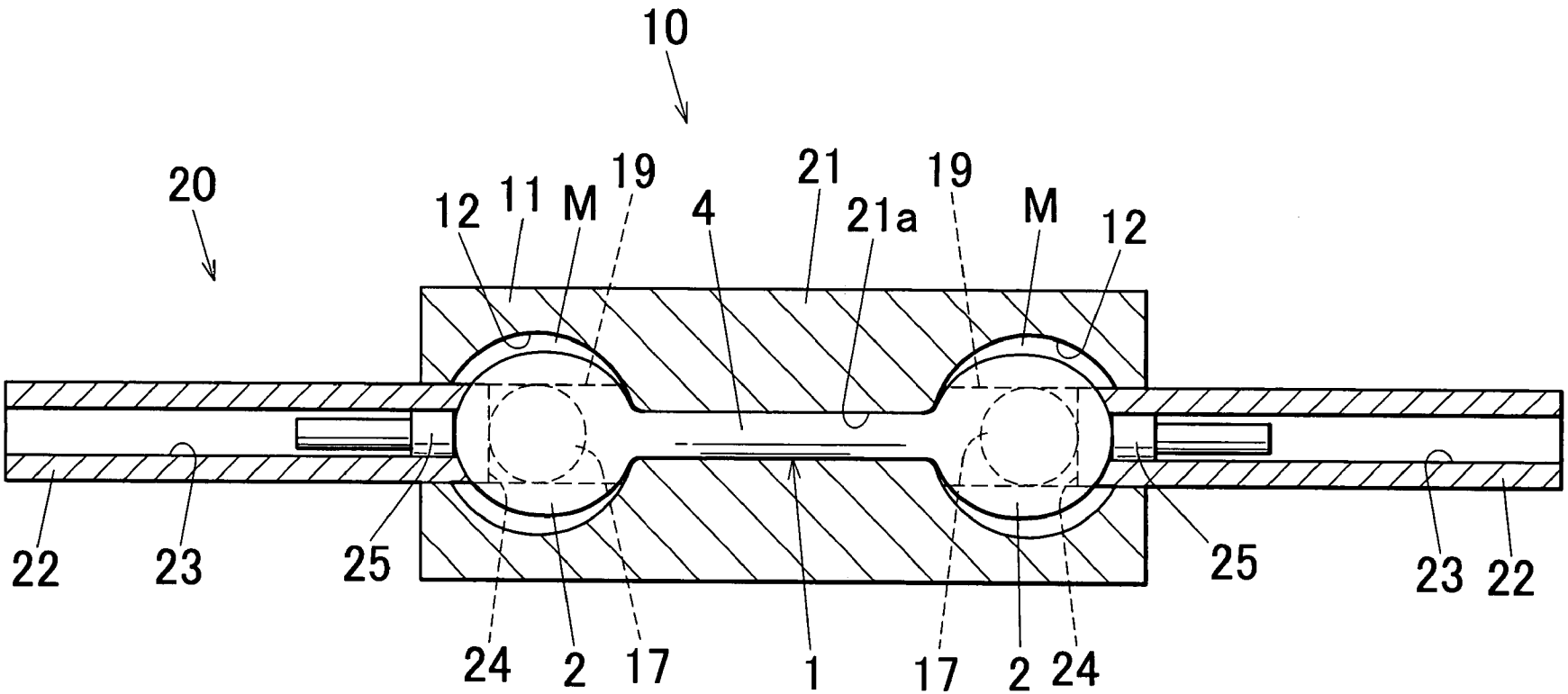
FIG. 8 is a horizontal cross-sectional view of the hole punching apparatus in the state shown in FIG. 7.
Figure 9:
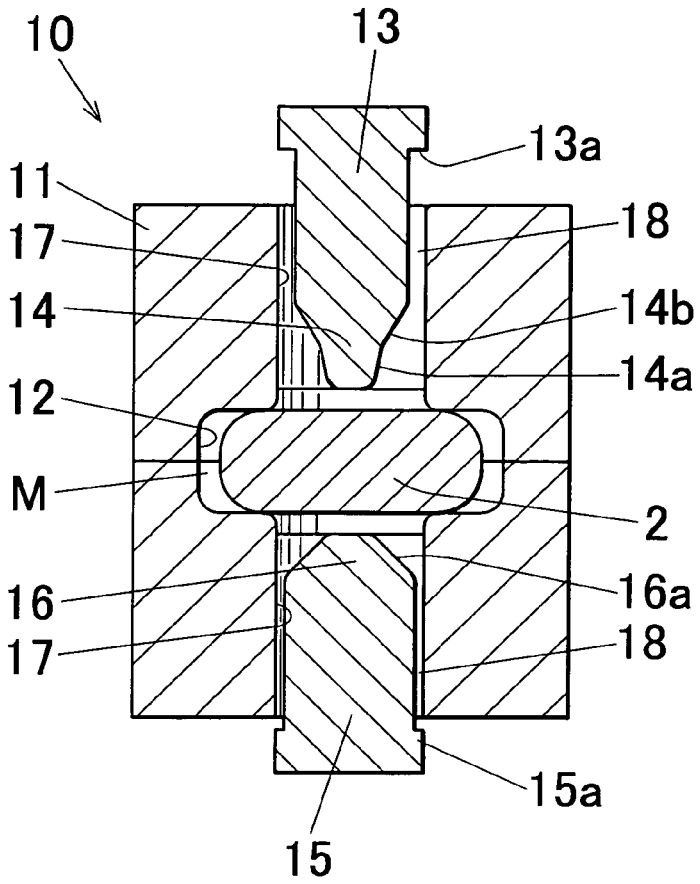
FIG. 9 is a cross-sectional view taken along the line B-B in FIG. 7.

As shown in FIGS. 7 to 9, when each hole punching scheduled portion 2 of the raw material 1 is expanded into a prescribed configuration, the movements of the pressure punches 25 and the guides 22 are terminated. At this time, there remains a portions not filled with the material of the hole punching scheduled portion 2 of the raw material 1, i.e., unfilled portions M, in the cavity 12. In this state, the hole punching scheduled portion 2 of the raw material 1 has been expanded into an approximately circular shape only in the widthwise directions, almost not in the thickness direction.

Both the hole punching scheduled portions 2 and 2 of the raw material 1 are expand in diameter as mentioned above.

Figure 10:
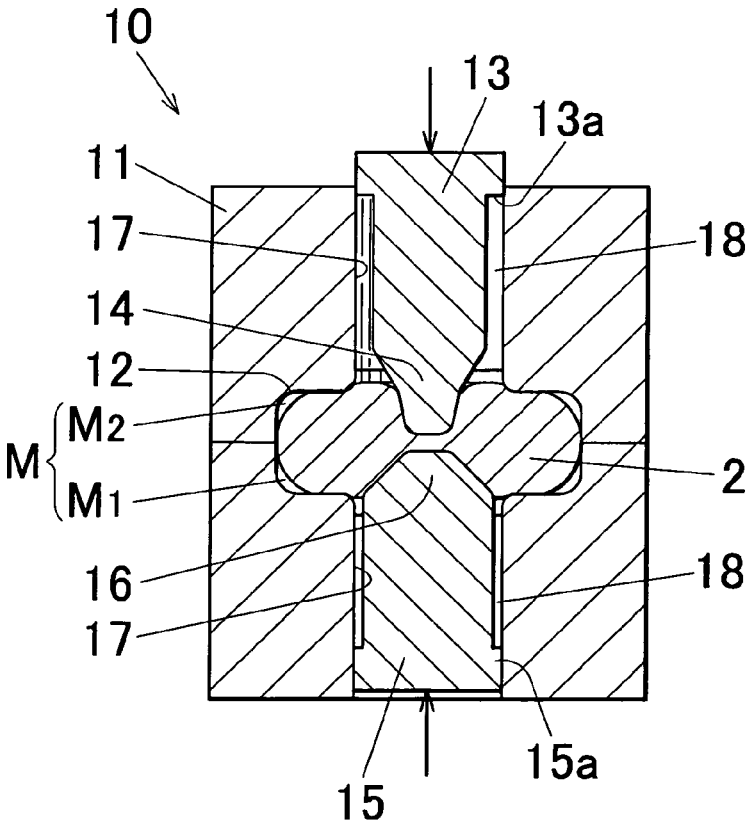
FIG. 10 is a cross-sectional view of the hole punching apparatus in the state in which the hole punching scheduled portion of the raw material was expanded with the hole punching apparatus.

Next, as shown in FIG. 10, hole punching is executed to each hole punching scheduled portion 2 formed by expanding the raw material 1 according to the following procedures.

Without removing each expanded hole punching scheduled portion 2 of the raw material 1 from the cavity 12, or in a state in which each expanded hole punching scheduled portion 2 remains in the cavity 12, the small diameter punch 13 and the large diameter punch 15 are simultaneously advanced into the cavity 12 by operating the punch driving apparatuses 30 and 30. With this, both the punches 13 and 15 simultaneously press the hole punching scheduled portion 2 from the opposite sides across the hole punching scheduled portion 2 so that the tip ends of both the punches 13 and 15 do not come into contact with each other. In this embodiment, both the punches 13 and 15 press the hole punching scheduled portion 2 from the expansion restriction direction sides of the hole punching scheduled portion 2 by the protruded portions 24 and 24 of the guide 22 (i.e., both thickness sides of the hole punching scheduled portion 2). Thus, as shown in FIG. 10, the tip end portions 14 and 16 of both the punches 13 and 15 are pressed into the hole punching scheduled portion 2 to thereby expand the hole punching scheduled portion 2 within the cavity 12 [EXPANDING STEP].

At this expanding step, however, as shown in this figure, portions in the cavity 12 where the material of the hole punching scheduled portion 2 is not filled, i.e., unfilled portions M, remain in the state where the hole punching scheduled portion 2 of the raw material 1 has been extended.

At this expanding step, it is preferable to simultaneously press the hole punching scheduled portion 2 with both the punches 13 and 15. If the pressurization of the hole punching scheduled portion 2 with both the punches 13 and 15 is not performed simultaneously, the inflow amount of the material of the hole punching scheduled portion 2 into the gaps 18 and 18 between the peripheral surfaces of the punches 13 and 15 and the peripheral surfaces of the punch insertion holes 17 and 17 increases, which may cause deterioration of the material yield. In the present invention, however, it is not always required to simultaneously perform the pressurization of the hole punching scheduled portion 2 with both the punches 13 and 15.

Figure 11:
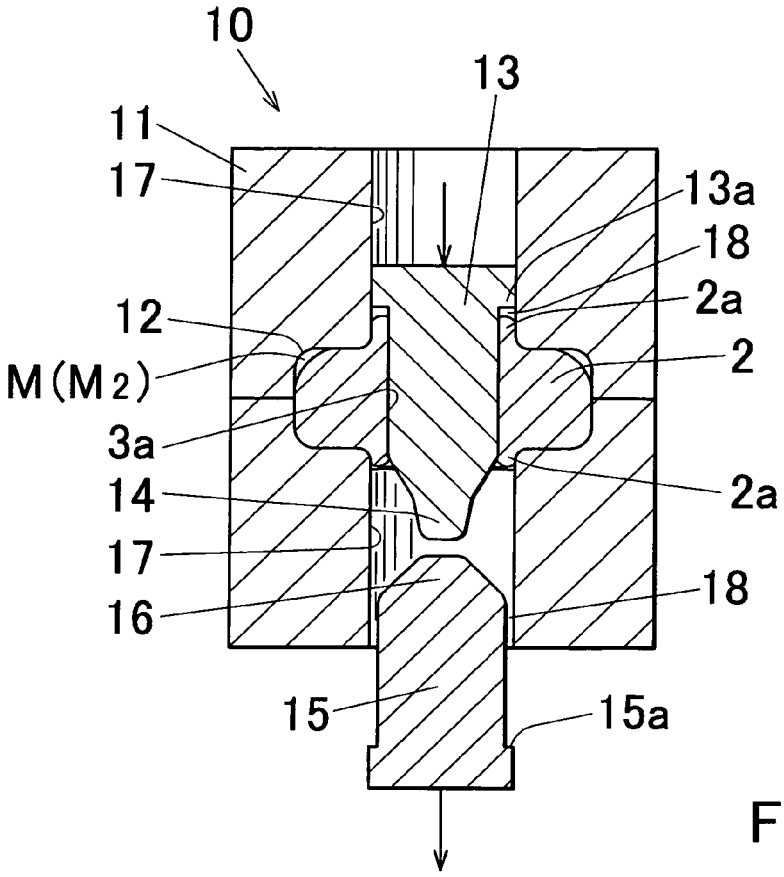
FIG. 11 is a cross-sectional view of the hole punching apparatus in the state in which the hole punching scheduled portion of the raw material was penetrated by a small diameter punch with the hole punching apparatus.

Subsequently, as shown in FIG. 11, while releasing the pressurization to the hole punching scheduled portion 2 of the raw material 1 with the large diameter punch 15 by retreating the large diameter punch 15 from the cavity 12, the tip end portion 14 of the small diameter punch 13 is pressed into the hole punching scheduled portion 2 more deeply to penetrate the small diameter punch 13 into the hole punching scheduled portion 2 in the thickness direction [PENETRATION STEP BY SMALL DIAMETER PUNCH 13]. Consequently, a small diameter through-hole 3*a* corresponding to the diameter of the small diameter punch 13 is formed in the hole punching scheduled portion 2. In the present invention, the small diameter punch 13 can penetrate the hole punching scheduled portion 2 after releasing the pressurization to the hole punching scheduled portion 2 of the raw material 1 by the large diameter punch 15.

The penetration operation of the small diameter punch 13 into the hole punching scheduled portion 2 causes the excessive material 2*a* of the hole punching scheduled portion 2 to be flowed into the gaps 18 and 18 between the peripheral surfaces of the punches 13 and 15 and the peripheral surfaces of the punch insertion holes 17 and 17 from the inside of the cavity 12. This inflow excessive material 2*a* cause burrs. Furthermore, the inflow excessive material 2*a* is dammed by the dam portions 13*a* and 15*a* to thereby prevent the discharge of the excessive material 2*a* to the outside. Furthermore, in accordance with the penetration operation of this small diameter punch 13, among the unfilled portions M in the cavity 12, the front side unfilled portion M1 located at the front side of the penetration direction of the small diameter punch 13 will be filled with the material of the hole punching scheduled portion 2 of the raw material 1.

Figure 12:
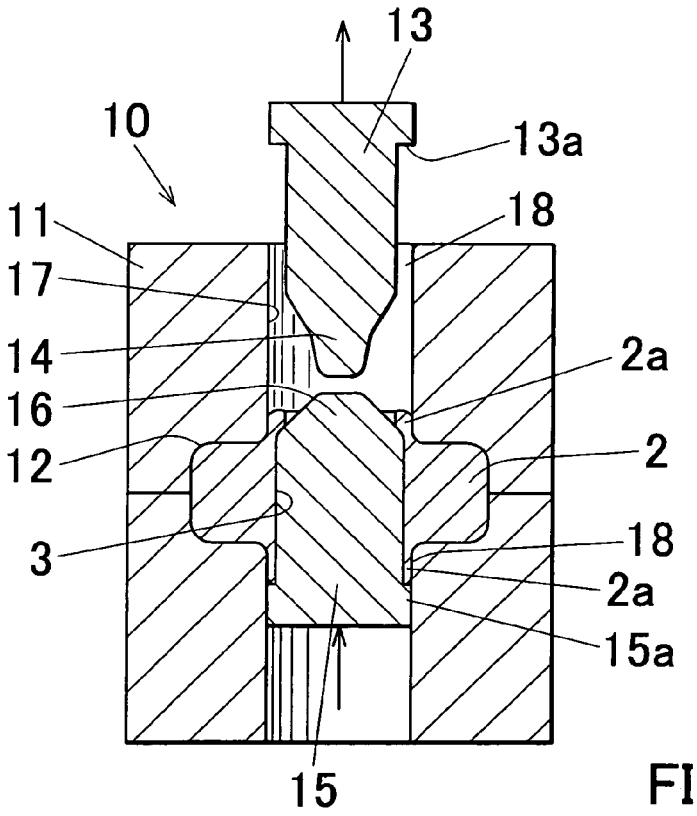
FIG. 12 is a cross-sectional view of the hole punching apparatus in the state in which the hole punching scheduled portion of the raw material was penetrated by a large diameter punch with the hole punching apparatus.

Next, as shown in FIG. 12, while pulling out the small diameter punch 13 penetrated in the hole punching scheduled portion 2 by retreating the small diameter punch 13 from the cavity 12, the tip end portion 16 of the large diameter punch 15 is pressed into the small diameter hole 3*a* formed in the hole punching scheduled portion 2 to thereby penetrate the large diameter punch 15 in the hole punching scheduled portion 2 [PENETRATION STEP BY LARGE DIAMETER PUNCH 15]. With this, the small diameter hole 3*a* is expanded, which in turn can form a desired large diameter hole 3 corresponding to the diameter of the large diameter punch 15 in the hole punching scheduled portion 2. In the present invention, the penetration of the large diameter punch 15 into the hole punching scheduled portion 2 can be performed after pulling out the small diameter punch 13 from the hole punching scheduled portion 2.

The penetration operation of the large diameter punch 15 into the hole punching scheduled portion 2 causes the excessive material 2*a* of the hole punching scheduled portion 2 to flow into the gaps 18 and 18 between the peripheral surfaces of punches 13 and 15 and the peripheral surfaces of the punch insertion holes 17 and 17 from the inside of the cavity 12. The inflow excessive material 2*a* cause burrs. Furthermore, the inflow excessive material 2*a* is dammed by the dam portions 13*a* and 15*a* of the punches 13 and 15 to thereby prevent the discharge of the excessive material 2*a* to the outside. Furthermore, in accordance with the penetration operation of this large diameter punch 15, among the unfilled portions M in the cavity 12, the front side unfilled portion M2 located at the front side of the penetration direction of the large diameter punch 15 will be filled with the material of the hole punching scheduled portion 2 of the raw material 1. Consequently, all of the unfilled portions M in the cavity 12 disappear, and the entire cavity 12 is filled with the material.

Next, the large diameter punch 15 is retreated from the cavity 12 to pull out the large diameter punch 15 penetrated in the hole punching scheduled portion 2 from the hole punching scheduled portion 2.

Next, the closed die 11 and the fixing die 21 are disassembled to remove the raw material 1 from the inside of the cavity 12. Thereafter, burrs 2*a* formed on the periphery of the hole 3 are removed as need arises to obtain a prescribed hole punched product (preform) as shown in FIG. 13.

Thus, in the hole punching method of the aforementioned embodiment, the hold punching scheduled portion 2 of the raw material 1 disposed within the cavity 12 of the closed die 11 is pressed from the opposite sides thereof across the hold punching scheduled portion 2 with the pair of large and small diameter punches 13 and 15 to expand the hole punching scheduled portion 2 so that unfilled portions M remain in the cavity 12. Therefore, the hole punching scheduled portion 2 can be expanded within the cavity 12 at a low load.

Furthermore, a hole 2*a* can be formed by a relatively small load since a small diameter hole 2*a* is opened in the hole punching scheduled portion 2 by penetrating the small diameter punch 13 into the hole punching scheduled portion 2 of the raw material 1. Furthermore, the penetration operation of the small diameter punch 13 causes the material of the hole punching scheduled portion 2 of the raw material 1 to be filled in the unfilled portion M1 located at the penetration front side of the small diameter punch 13 among the unfilled portions M in the cavity 12.

Furthermore, since the small diameter hole 2*a* is expanded by penetrating the large diameter punch 15 into the small diameter hole 2*a* formed in the hole punching scheduled portion 2 of the raw material 1 to form a large diameter hole 3 in the hole punching scheduled portion 2, the hole 3 can be opened at a relatively low load. Furthermore, the penetration operation of the large diameter punch 15 causes the material of the hole punching scheduled portion 2 of the raw material 1 to be filed in the unfilled portion M2 located at the penetration front side of the large diameter punch 15 among the unfilled portions M in the cavity 12. Consequently, all the unfilled portions M in the cavity 12 disappear and the entire cavity 12 is filled with the material, which prevents occurrence of underfill.

In the hole punching method of this embodiment, no step of punching and removing the material of the hole punching scheduled portion 2 of the raw material 1 is included, resulting in high material yield.

Furthermore, the tapered tip end portion 14 of the small diameter punch 13 enables penetration of the hole punching scheduled portion 2 of the raw material 1 at a low load. Furthermore, since the peripheral surface of the tip end portion 14 of the small diameter punch 13 is formed by two stepped taper surfaces 14*a* and 14*b* arranged so as to decrease in taper angle $\alpha 1$ and $\alpha 2$ gradually stepwise toward the tip of the small diameter punch 13, the forming load can be adjusted to a prescribed value by setting the two stepped taper angles $\alpha 1$ and $\alpha 2$ of the small diameter punch 13. The penetration operation of the small diameter punch 13 enables an effective radially outward expansion of the hole punching scheduled portion 2 of the raw material 1, which enables assured filling of the material of the hole punching scheduled portion 2 of the raw material 1 to the small diameter punch penetration front side portion M1 of the unfilled portions M in the cavity 12.

Furthermore, the tapered tip end portion 16 of the large diameter punch 15 enables penetration of the large diameter punch 15 into the hole punching scheduled portion 2 of the raw material 1 at a low load. Furthermore, the one step taper surface 16*a* of the peripheral surface of the tip end portion 16 of the large diameter punch 15 enables adjustment of the forming load to a prescribed value by setting the taper angle $\beta 1$ of the taper surface 16*a*. And, the penetration operation of the large diameter punch 15 enables effective radially outward expansion of the hole punching scheduled portion 2 of the raw material 1, thereby enabling assured filling of the material of the hole punching scheduled portion 2 of the material 1 to the large diameter punch penetration front side portion M2 of the unfilled portions M in the cavity 12, which assuredly prevents occurrence of underfill.

Furthermore, in the state where each punch 13 and 15 is inserted in the corresponding punch insertion hole 17 and 17, gaps 18 and 18 for receiving excessive material 2*a* of the hole punching scheduled portion 2 of the raw material 1 are formed between the peripheral surfaces of the punches 13 and 15 and the peripheral surfaces of the punch insertion holes 17 and 17. Accordingly, this hole punching method can be classified into a diverging type forging method. Therefore, the material of hole punching scheduled portion 2 of the raw material 1 can be filled in the unfilled portions M in the cavity 12 at a relatively low load.

In addition, since the dam portion 13*a* and 15*a* for preventing the outward flow of the excessive material 2*a* flowed into the gap 18 is formed at the peripheral surface of each punch 13 and 15, the excessive material 2*a* can be prevented from flowing out of the closed die 11.

At the expansion step, the hole punching scheduled portion 2 of the raw material 1 is pressed by both the punches 13 and 15 so that the tip ends of the punches 13 and 15 do not come into contact with each other. Therefore, occurrence of breakages and/or damages of the punch tip end portions 14 and 16, which may occur due to the contact of the tips of both the punches 13 and 15, can be prevented.

The hole punching method of this embodiment includes, before the expanding step, a diameter expansion step in which the hole punching scheduled portion 2 of the raw material 1 is expanded in diameter in advance. At the expanding step, in the state where the hole punching scheduled portion 2 of the raw material 1 expanded in diameter at the diameter expansion step is disposed in the cavity 12, the hole punching scheduled portion 2 is pressed with both the punches 13 and 15 from the diameter expansion restriction sides by the guide protruded portions 24 and 24. Therefore, in the case where the hole punching scheduled portion 2 of the raw material 1 is expanded in diameter beforehand and then hole punching is executed to the hole punching scheduled portion 2, these processing can be performed effectively.

Although an embodiment of the present invention was explained above, the present invention is not limited to the aforementioned embodiment and can be modified in various manners.

For example, the hole punching method and the hole punching apparatus according to the present invention are not limited to a method and an apparatus for manufacturing a preform for manufacturing arms of vehicles, and can also be used to manufacture various preforms for industrial products, such as, e.g., a preform for connecting rods or a preform for gears with a shaft hole.

Furthermore, in the present invention, the hole punching scheduled portion 2 of the raw material 1 can be only one place, such as, e.g., an axial intermediate portion or an axial one end portion of the raw material 1. Needless to say, in the present invention, the shape of the raw material 1 is not limited to a bar shape, and the present invention can be applied to raw materials 1 of various configurations. Furthermore, in the present invention, the raw material 1 can be an extruded material, a rolled material, such as, e.g., a continuously cast rolled material manufactured by a Properzi method, or can be any material manufactured by any other production methods.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be applied to a hole punching method and a hole punching apparatus for manufacturing a hole punched product, such as, e.g., an arm or a connecting rod for vehicles (e.g., automobiles, railroad vehicles).

What is claimed is:

1. A hole punching method, comprising:

press-expanding a hole punching scheduled portion of a raw material disposed in a molding cavity of a closed die which molds the hole punching scheduled portion of the raw material into a scheduled shape by pressing the hole punching scheduled portion from opposite sides thereof across the hole punching scheduled portion with a pair of large diameter punch and small diameter punch different in diameter and arranged so as to face each other so that unfilled portions remain in the molding cavity;

penetrating the small diameter punch into the hole punching scheduled portion of the raw material after the press-expanding so as not to punch and remove a material of the hole punching scheduled portion with the small diameter punch while releasing or after releasing pressurization by the large diameter punch to the hole punching scheduled portion; and penetrating the large diameter punch into the hole punching scheduled portion of the raw material after the penetrating of the small diameter punch so as not to punch and remove the material of the hole punching scheduled portion with the large diameter punch while pulling out or after pulling out the small diameter punch penetrated in the hole punching scheduled portion of the raw material from the hole punching scheduled portion of the raw material, wherein the penetrating of the small diameter punch and the penetrating of the large diameter punch are executed to fully fill the molding cavity with the material of the hole punching scheduled portion of the raw material.

2. The hole punching method as recited in claim 1, wherein a tip end portion of the small diameter punch is formed into a tapered shape, and wherein a peripheral surface of the tip end portion of the small diameter punch is formed by plural stepped taper surfaces arranged so as to decrease in taper angle gradually stepwise toward the tip end portion of the small diameter punch.

3. The hole punching method as recited in claim 2, wherein, when the number of steps of the taper surfaces forming the peripheral surface of the tip end portion of the small diameter punch is $N \geqq 2$, a tip end portion of the large diameter punch is formed into a tapered shape, and a peripheral surface of the tip end portion of the large diameter punch is formed by stepped taper surfaces whose step number is smaller than N and arranged so as to decrease a taper angle gradually stepwise toward the tip end portion of the large diameter punch, or formed by a single step taper surface.

4. The hole punching method as recited in claim 1, wherein the closed die is provided with punch insertion holes each for inserting each punch, each punch insertion hole being communicated with the molding cavity, and wherein, in a state in which each punch is inserted in the corresponding punch insertion hole, gaps for receiving excessive material of the hole punching scheduled portion of the raw material from the molding cavity are formed between peripheral surfaces of the punches and peripheral surfaces of the punch insertion holes.

5. The hole punching method as recited in claim 4, wherein a dam portion for preventing the excessive material flowed into the gaps from discharging to an outside is formed at the peripheral surface of the punch so as to expand toward a radially outward of the punch.

6. The hole punching method as recited in claim 1, wherein, at the step of press-expanding, the hole punching scheduled portion is pressed from opposite sides thereof across the hole punching scheduled portion with both the punches so that the tip ends of both the punches do not come into contact with each other.

7. The hole punching method as recited in any one of claims 1 to 6, wherein the raw material is a bar shaped material in which an axial prescribed portion of the raw material is defined as the hole punching scheduled portion, wherein the method further includes a diameter expanding step of expanding the hole punching scheduled portion of the raw material with an upsetting apparatus in advance to the press-expanding step, the upsetting apparatus being provided with a fixing die for securing the raw material, the fixing die being connected to the closed die, a guide having an insertion hole for inserting and holding the hole punching scheduled portion of the raw material in a buckling preventing state, and a pressure punch, and the guide having a pair of diameter expansion preventing protruded portions each protruded in an axial direction of the guide and integrally formed at opposed portions of the tip end portion of the guide across the insertion hole, wherein, at the diameter expansion step, the hole punching scheduled portion of the raw material secured to the fixing die is disposed in the molding cavity and the hole punching scheduled portion of the raw material is inserted and held in the insertion hole of the guide, and then, the guide is moved in a direction opposite to a moving direction of the pressure punch while axially pressing the hole punching scheduled portion of the raw material with the pressure punch by moving the pressure punch, to thereby expand the hole punching scheduled portion of the raw material exposed between the tip end portion of the guide and the fixing die in the molding cavity in a state in which contacting portions of the hole punching scheduled portion in contact with the guide protruded portions are prevented from being expanded in diameter, and wherein, at the press-expanding step, the expanded hole punching scheduled portion of the raw material is pressed with both the punches from both sides of the hole punching scheduled portion prevented in diameter expansion by the guide protruded portions in a state in which the hole punching scheduled portion expanded in diameter is disposed in the molding cavity.

8. A hole punched product obtained by the hole punching method as recited in any one of claims 1 to 6.

9. A hole punching apparatus comprising:

a closed die having a molding cavity which molds a hole punching scheduled portion of a raw material into a scheduled shape; and a pair of large diameter punch and small diameter punch different in diameter and disposed at opposite sides across a hole punching scheduled portion of a raw material disposed in the molding cavity of the closed die, wherein the hole punching scheduled portion of the raw material disposed in the molding cavity of the closed die is expanded with both the punches by pressing the hole punching scheduled portion from opposite sides across the hole punching scheduled portion, then, while releasing or after releasing pressurization by the large diameter punch to the hole punching scheduled portion, the small diameter punch is penetrated into the hole punching scheduled portion of the raw material so as not to punch and remove a material of the hole punching scheduled portion with the small diameter punch, thereafter, while pulling out or after pulling out the small diameter punch penetrated in the hole punching scheduled portion of the raw material from the hole punching scheduled portion, the hole punching scheduled portion of the raw material is penetrated by the large diameter punch so as not to punch and remove the material of the hole punching scheduled portion with the large diameter punch, wherein a tip end portion of the small diameter punch is formed into a tapered shape, wherein a peripheral surface of the tip end portion of the small diameter punch is formed by plural stepped taper surfaces arranged so as to decrease in taper angle gradually stepwise toward the tip end portion of the small diameter punch, and wherein when the number of steps of the taper surfaces forming the peripheral surface of the tip end portion of the small diameter punch is $N \geqq 2$, a tip end portion of the large diameter punch is formed into a tapered shape, and a peripheral surface of the tip end portion of the large diameter punch is formed by stepped taper surfaces whose step number is smaller than N and arranged so as to decrease a taper angle gradually stepwise toward the tip end portion of the large diameter punch, or formed by a single step taper surface.

10. The hole punching apparatus as recited in claim 9, wherein the closed die is provided with punch insertion holes each for inserting each punch, each punch insertion hole being communicated with the molding cavity, and wherein, in a state in which each punch is inserted in the corresponding punch insertion hole, gaps for receiving excessive material of the hole punching scheduled portion of the raw material from the molding cavity are formed between peripheral surfaces of the punches and peripheral surfaces of the punch insertion holes.

11. The hole punching apparatus as recited in claim 10, wherein a dam portion for preventing the excessive material flowed into the gaps from discharging to an outside is formed at the peripheral surface of the small diameter punch so as to expand toward a radially outward of the small diameter punch.

12. The hole punching apparatus as recited in any one of claims 9, 10 and 11, wherein the raw material is a bar shaped material in which an axial prescribed portion of the raw material is defined as the hole punching scheduled portion, wherein the apparatus further includes an upsetting apparatus for expanding the hole punching scheduled portion of the raw material before expanding the hole punching scheduled portion of the raw material, wherein the upsetting apparatus is provided with a fixing die for securing the raw material, the fixing die being connected to the closed die, a guide having an insertion hole for inserting and holding the hole punching scheduled portion of the raw material in a buckling preventing state, and a pressure punch for axially pressing the hole punching scheduled portion of the raw material inserted in the insertion hole of the guide, and a guide driving apparatus for moving the guide in a direction opposite to a moving direction of the pressure punch, the guide having a pair of diameter expansion preventing protruded portions each protruded in an axial direction of the guide and integrally formed at opposed portions of the tip end portion of the guide across the insertion hole, and wherein a part of a peripheral surface of the hole punching scheduled portion is brought into contact with side surfaces of the protruded portions of the guide at the time of expanding the hole punching scheduled portion of the raw material to thereby prevent a contacting portion of the hole punching scheduled portion in contact with the protruded portions from being expanded.

13. A hole punching apparatus comprising:

a closed die having a molding cavity which molds a hole punching scheduled portion of a raw material into a scheduled shape; and a pair of large diameter punch and small diameter punch different in diameter and disposed at opposite sides across a hole punching scheduled portion of a raw material disposed in the molding cavity of the closed die, wherein the hole punching scheduled portion of the raw material disposed in the molding cavity of the closed die is expanded with both the punches by pressing the hole punching scheduled portion from opposite sides across the hole punching scheduled portion, then, while releasing or after releasing pressurization by the large diameter punch to the hole punching scheduled portion, the small diameter punch is penetrated into the hole punching scheduled portion of the raw material so as not to punch and remove a material of the hole punching scheduled portion with the small diameter punch, thereafter, while pulling out or after pulling out the small diameter punch penetrated in the hole punching scheduled portion of the raw material from the hole punching scheduled portion, the hole punching scheduled portion of the raw material is penetrated by the large diameter punch so as not to punch and remove the material of the hole punching scheduled portion with the large diameter punch, wherein the raw material is a bar shaped material in which an axial prescribed portion of the raw material is defined as the hole punching scheduled portion, wherein the apparatus further includes an upsetting apparatus for expanding the hole punching scheduled portion of the raw material before expanding the hole punching scheduled portion of the raw material, wherein the upsetting apparatus is provided with a fixing die for securing the raw material, the fixing die being connected to the closed die, a guide having an insertion hole for inserting and holding the hole punching scheduled portion of the raw material in a buckling preventing state, and a pressure punch for axially pressing the hole punching scheduled portion of the raw material inserted in the insertion hole of the guide, and a guide driving apparatus for moving the guide in a direction opposite to a moving direction of the pressure punch, the guide having a pair of diameter expansion preventing protruded portions each protruded in an axial direction of the guide and integrally formed at opposed portions of the tip end portion of the guide across the insertion hole, and wherein a part of a peripheral surface of the hole punching scheduled portion is brought into contact with side surfaces of the protruded portions of the guide at the time of expanding the hole punching scheduled portion of the raw material to thereby prevent a contacting portion of the hole punching scheduled portion in contact with the protruded portions from being expanded.

* * * * *